US009420371B2

(12) United States Patent
An et al.

(10) Patent No.: US 9,420,371 B2
(45) Date of Patent: Aug. 16, 2016

(54) USER DEVICE HAVING PLURALITY OF MICROPHONES AND OPERATING METHOD THEREOF

(71) Applicant: Samsung Electronics Co., Ltd., Gyeonggi-do (KR)

(72) Inventors: Jung-Yeol An, Seoul (KR); Cheol-Yong Park, Gyeonggi-do (KR); Gang-Youl Kim, Gyeonggi-do (KR); Gun-Hyuk Yoon, Gyeonggi-do (KR); Ki-Won Kim, Gyeonggi-do (KR); Seung-Yoon Heo, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 171 days.

(21) Appl. No.: 14/243,856

(22) Filed: Apr. 2, 2014

(65) Prior Publication Data

US 2014/0294196 A1 Oct. 2, 2014

(30) Foreign Application Priority Data

Apr. 2, 2013 (KR) ..... 10-2013-0035997

(51) Int. Cl.
*H04R 3/00* (2006.01)

(52) U.S. Cl.
CPC ..... *H04R 3/005* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 7,561,700 | B1 * | 7/2009 | Bernardi | H04R 3/005 381/313 |
| 2006/0165242 | A1 * | 7/2006 | Miki | H04R 3/005 381/59 |
| 2008/0175399 | A1 * | 7/2008 | Kim | H04T 5/04 381/57 |
| 2009/0190769 | A1 * | 7/2009 | Wang | H04R 3/005 381/66 |
| 2009/0196429 | A1 * | 8/2009 | Ramakrishnan | H04R 3/005 381/26 |
| 2011/0135126 | A1 * | 6/2011 | Gozen | H04R 25/505 381/313 |
| 2013/0117017 | A1 * | 5/2013 | Sun | G10L 21/0272 704/226 |

FOREIGN PATENT DOCUMENTS

| | | |
|---|---|---|
| JP | 2009-545257 | 12/2009 |
| KR | 10-1994-0020780 | 9/1994 |
| KR | 10-2010-0034288 | 4/2010 |
| KR | 10-2010-0324288 | 4/2010 |

* cited by examiner

*Primary Examiner* — Thang Tran

(57) ABSTRACT

A user device having a plurality of microphones and an operating method thereof are provided. The user device includes a plurality of microphones for converting sounds into electrical signals, an analysis unit for analyzing acoustic characteristics of the electrical signals outputted from the plurality of microphones, a switch unit for electrically connecting a specific microphone and a host device according to the analysis result of the analysis unit, and the host device for executing a function using an electrical signal outputted from the specific microphone. Various other exemplary embodiments are possible.

18 Claims, 14 Drawing Sheets

| MIC. / DELAY TIME | A MICROPHONE (ELECTRICAL DISCONNECTION TARGET) | B MICROPHONE (ELECTRICAL CONNECTION TARGET) |
|---|---|---|
| INITIAL PERIOD | 90% | 10% |
| MIDDLE PERIOD | 40% | 60% |
| END PERIOD | 10% | 90% |

FIG.14

USER DEVICE HAVING PLURALITY OF MICROPHONES AND OPERATING METHOD THEREOF

PRIORITY

The present application is related to and claims priority under 35 U.S.C. §119(a) to a Korean Patent Application filed in the Korean Intellectual Property Office on Apr. 2, 2013 and assigned Serial No. 10-2013-0035997, the contents of which are herein incorporated by reference.

TECHNICAL FIELD

The present disclosure relates to a user device having a plurality of microphones and an operating method thereof.

BACKGROUND

At present, owing to the growth of electronic communication industries, user devices such as mobile communication terminals (cellular phones), electronic schedulers, personal complex terminals and the like are becoming necessities to modern society while becoming a significant means of delivery of rapidly changing information. Also, the user devices can be changed into multimedia communication devices in view of a function providing various kinds of data transmission services and various supplementary services as well as a voice call service. Also, a user device with a touchscreen is being commercialized, and even a User Interface (UI) technology of controlling the user device is continuously being developed along with the growth of services capable of being provided through the user device. Commonly, the user device has a microphone which converts a sound into an electrical signal and is used for a call, voice recording and the like.

SUMMARY

To address the above-discussed deficiencies, it is a primary object to make use of electrical signals outputted from a plurality of microphones adaptively to a microphone-related function (such as a call, voice recognition, voice recording and the like).

Various exemplary embodiments of the present disclosure can have a plurality of microphones, and make use of a path of a microphone outputting an electrical signal suitable to a microphone-related function.

Various exemplary embodiments of the present disclosure can select an electrical signal having an acoustic characteristic (such as frequency, volume, echo, clipping, saturation and the like) suitable to a function among electrical signals outputted from a plurality of microphones, and execute the function using the selected electrical signal.

The above aspects are achieved by providing a user device having a plurality of microphones and an operating method thereof.

According to various exemplary embodiments of the present disclosure, there is provided a user device including a plurality of microphones, an analysis unit, a switch unit, and a host device. The microphones convert sounds into electrical signals. The analysis unit analyzes acoustic characteristics of the electrical signals outputted from the plurality of microphones. The switch unit electrically connects a specific microphone and a host device according to the analysis result of the analysis unit. The host device executes a function using an electrical signal outputted from the specific microphone.

According to various exemplary embodiments of the present disclosure, there is provided a user device including a 1st microphone and a 2nd microphone, a filter unit including a permanent operation adaptive filter and a periodic operation adaptive filter, a switch unit, a detection unit, a comparison unit, a control unit, and a host device. The 1st microphone and 2nd microphone convert sounds into electrical signals. The permanent operation adaptive filter and periodic operation adaptive filter are electrically connected with the 1st microphone and 2nd microphone respectively on a point-to-point basis and cancel echoes from electrical signals outputted from the 1st microphone and 2nd microphone. The switch unit switches an electrical connection path between the filter unit and the 1st microphone and 2nd microphone. The detection unit detects a 1st remnant echo not canceled by the permanent operation adaptive filter and a 2nd remnant echo not canceled by the periodic operation adaptive filter. The comparison unit compares the 1st remnant echo and the 2nd remnant echo. The control unit controls the switch unit according to the comparison result of the comparison unit. The host device executes a function using an electrical signal passing the permanent operation adaptive filter.

According to various exemplary embodiments of the present disclosure, there is provided a method including the operations of receiving electrical signals from a plurality of microphones, selecting an electrical signal suitable to a function among the received electrical signals, and executing the function using the selected electrical signal.

According to various exemplary embodiments of the present disclosure, there is provided a method including the operations of initiating a function, receiving a 1st electrical signal from a 1st microphone designated to the function, detecting an acoustic characteristic of the 1st electrical signal, if the acoustic characteristic of the 1st electrical signal is suitable to the function, executing the function using the 1st electrical signal, if the acoustic characteristic of the 1st electrical signal is unsuitable to the function, receiving a 2nd electrical signal from a 2nd microphone, detecting an acoustic characteristic of the 2nd electrical signal, if the acoustic characteristic of the 2nd electrical signal is suitable to the function, executing the function using the 2nd electrical signal, and, if the acoustic characteristic of the 2nd electrical signal is unsuitable to the function, executing the function using the 1st electrical signal.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 14 is an example table showing weights applied to electrical signals respectively when mixing the electrical signals outputted from two microphones during a delay time according to the present disclosure.

DETAILED DESCRIPTION

FIGS. 1 through 14, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged mobile electronic device. Preferred embodiments of the present disclosure will be described herein below with reference to the accompanying drawings. In the following description, well-known functions or constructions are not described in detail since they would obscure the invention in unnecessary detail. And, terms described below, which are defined considering functions in the present disclosure, can be changed according to user and operator's intention or practice. Therefore, the terms should be defined on the basis of the disclosure throughout this specification.

Figure 1:
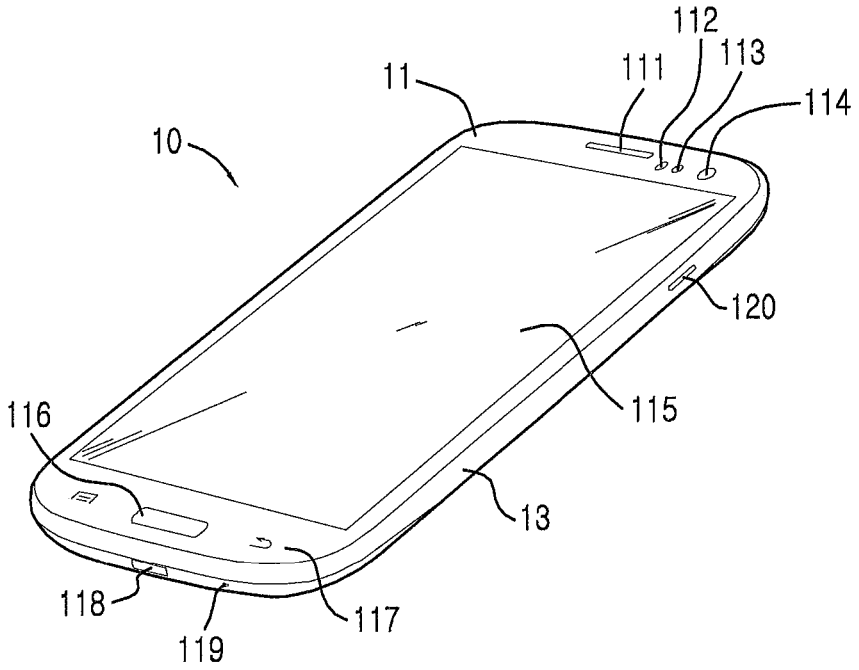
FIGS. 1 and 2 are example perspective views illustrating a user device according to the present disclosure.
Figure 2:
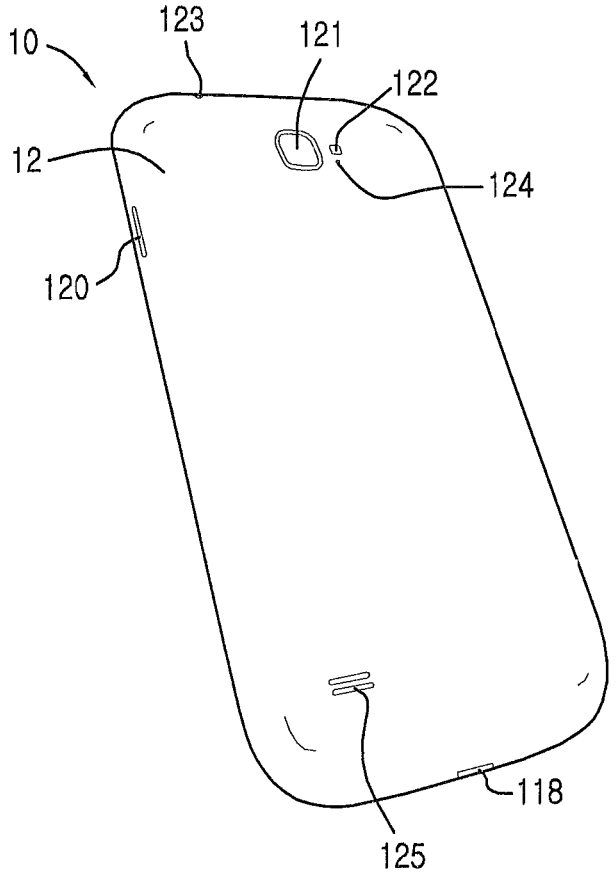

FIGS. 1 and 2 are example perspective views illustrating a user device according to the present disclosure.

Referring to FIG. 1, an earpiece speaker 111, a light sensor 112, a proximity sensor 113, and a front sensor 114 can be installed at an upper part of a front surface 11 of a user device 10. A touchscreen 115 can be installed at the center of the front surface 11 of the user device 10. A press button 116 and a touch button 117 can be installed at a lower part of the front surface 11 of the user device 10. An external connector terminal 118 and a 1st microphone 119 can be installed at a lower end of the user device 10. A slip button 120 can be installed at the right side of the user device 10, and a volume button (not shown) can be installed at the left side of the user device 10.

Referring to FIG. 2, a rear camera 121, a flash 122, and a 3rd microphone 124 can be installed at an upper part of a rear surface 12 of the user device 10. A multimedia speaker 125 can be installed at a lower part of the rear surface 12 of the user device 10. A 2nd microphone 123 can be installed at an upper end of the user device 10.

The user device 10 can include a Printed Circuit Board (PCB) (not shown) electrically communicating with the aforementioned elements. A majority of the aforementioned elements can be mounted on the PCB or can be electrically connected to the PCB through an electrical connection means such as a Flexible PCB (FPCB), a cable and the like. The PCB can be a substrate on which a basic circuit and a plurality of electronic parts are mounted. The PCB can set an execution environment of the user device 10, maintain information of the user device 10, make the user device 10 stably driven, and make data input/output exchange of all devices of the user device 10 smooth.

Also, the user device 10 can include a housing 13. The housing 13 can play a role of housing and fixing the aforementioned elements of the user device 10 as well as form an appearance of the user device 10. Among the aforementioned elements, the touchscreen 115, the front and rear cameras 114 and 121, respectively, the flash 122, the external connector terminal 118 and the like can be exposed through openings provided in the housing 13. The housing 13 can have holes for sound inlet and outlet at portions in which the speakers 111 and 125 and the microphones 119, 123, and 124 are overlapped.

Figure 10:
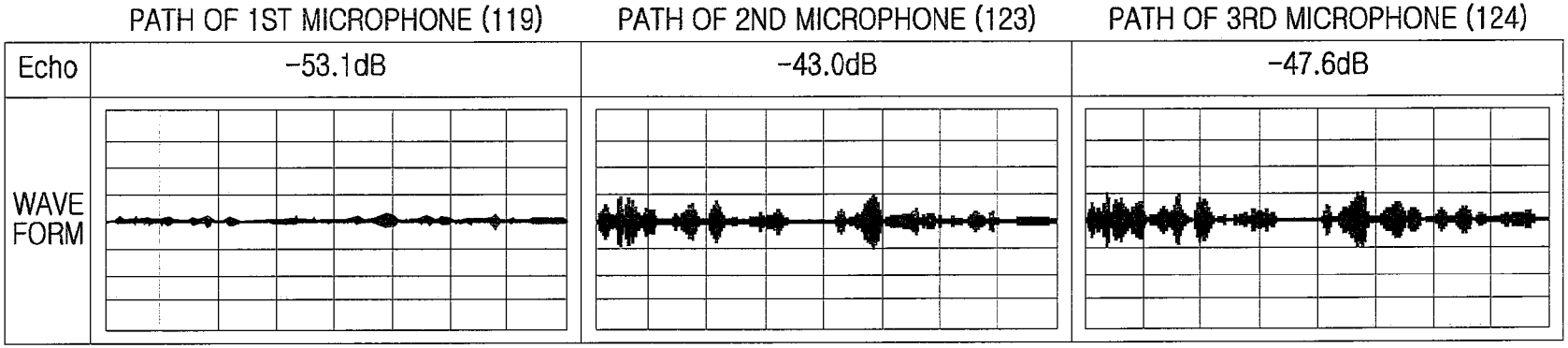
FIGS. 10 to 12 are example diagrams illustrating an amplitude and waveform of an echo which is introduced into each microphone when a user makes a call with a counterpart with seizing both sides of a user device and getting the user device close to the face according to the present disclosure.
Figure 11:
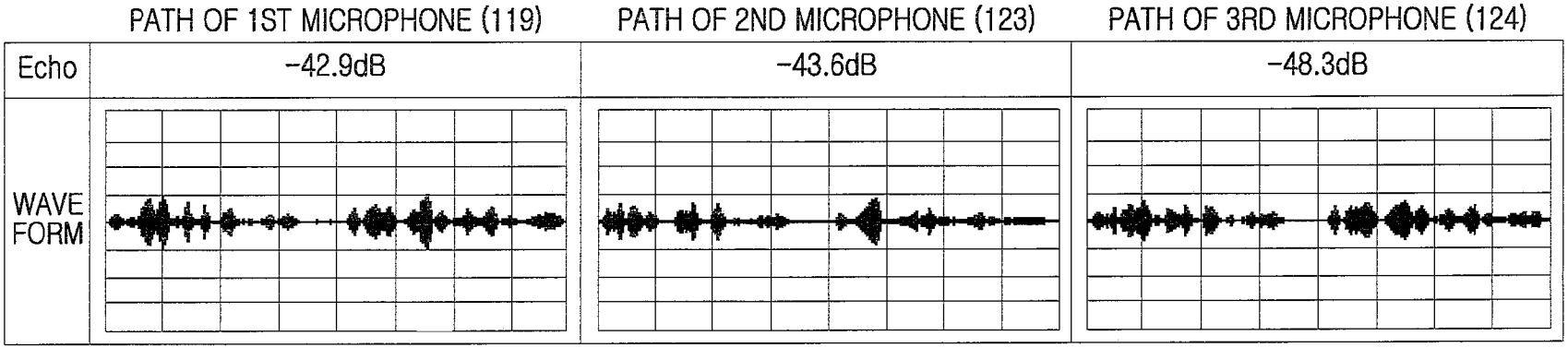
Figure 12:
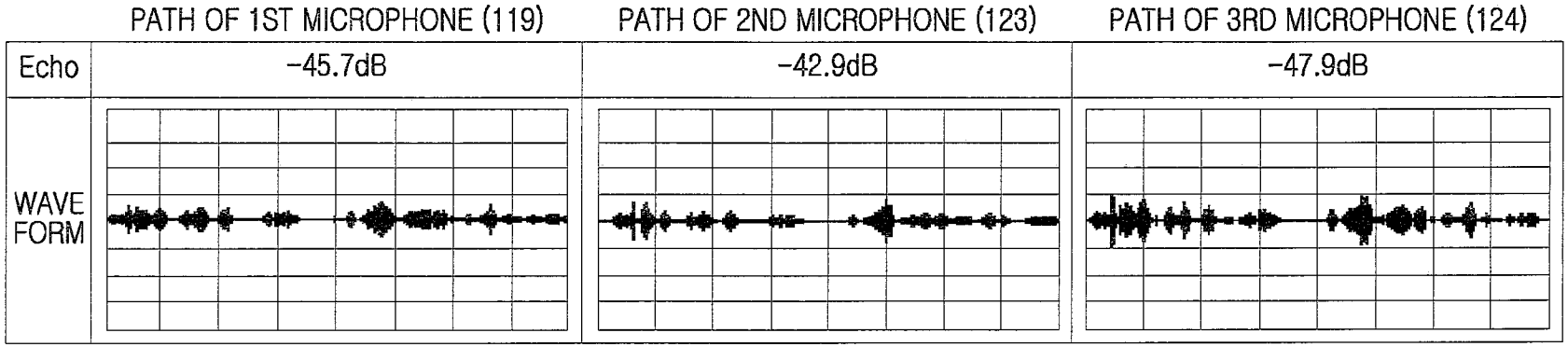
Figure 13:
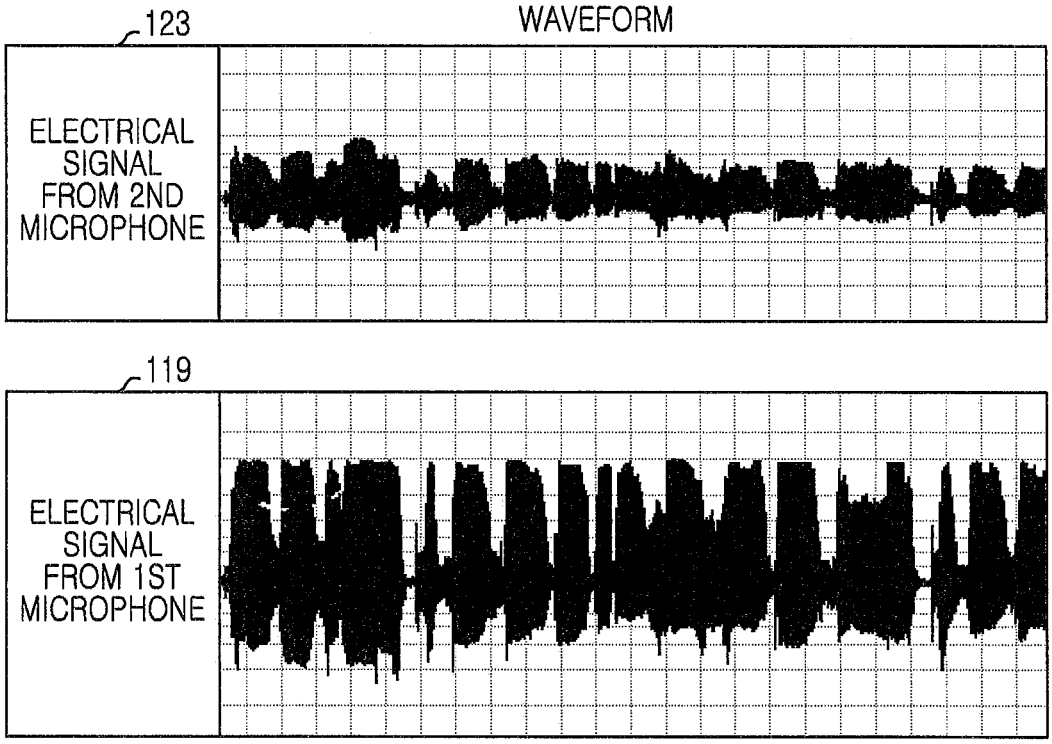
FIG. 13 is an example diagram illustrating waveforms of electrical signals outputted from a 1st microphone and a 2nd microphone when a user speaks with getting the mouth close to the 1st microphone disposed at a lower end of a user device according to the present disclosure.

The microphones 119, 123, and 124 can introduce sounds through the holes, and can convert the sounds into electrical signals. Also, the PCB can process the electrical signals outputted from the microphones 119, 123, and 124. The sounds can be changed while being introduced into the microphones 119, 123, and 124. Accordingly, acoustic characteristics of the electrical signals outputted from the microphones 119, 123, and 124 can be varied respectively. Particularly, acoustic characteristics of sounds introduced into the microphones 119, 123, and 124 can be varied because the microphones 119, 123, and 124 are distant from one another. For example, in a case where a user speaks with seizing the user device 10 and getting close to the face, a sound introduced into the lower microphone 119 can be large in volume while sounds introduced into the upper microphone 123 and the rear microphone 124 can be relatively small in volume. As a result, acoustic characteristics of converted electrical signals outputted from the microphones 119, 123, and 124 of the user device 10 can be varied according to a situation of the user device 10. For example, since the user device 10 can be in various situations such as a situation of being seized with a user's hand, a situation of being mounted on a dock, a situation of being equipped with a cover, and the like, the acoustic characteristics of the converted electrical signals outputted from the microphones 119, 123, and 124 can be varied. FIGS. 10 to 12 are example diagrams illustrating an amplitude and waveform of an echo which is introduced into each microphone when a user makes a call with a counterpart with seizing both sides of a user device and getting the user device close to the face according to the present disclosure. FIG. 11 is an example illustrating an embodiment where the user stops a hole of the microphone 119 close to the mouth with the other hand, and FIG. 12 is an example illustrating an embodiment where the user hides the mouth with the other hand. The term echo can refer to a phenomenon in which a sound wave coming out from a sound source reflects from an object surface and again returns to the sound source. In other words, the term echo can refer to a phenomenon in which a counterpart's voice outputted through the earpiece speaker 111 goes through a reflection path and is introduced into the microphones 119, 123, and 124 together with a noise. Referring to FIG. 10, it can be appreciated that a quantity of echoes inputted to the PCB through a path of the 1st microphone 119 is the least. Referring to FIGS. 11 and 12, it can be appreciated that a quantity of echoes inputted to the PCB through a path of the 3rd microphone 124 is the least. FIG. 13 is an example illustrating waveforms of electrical signals outputted from a 1st microphone and a 2nd microphone when a user speaks with getting the mouth close to the 1st microphone disposed at a lower end of a user device according to the present disclosure. FIG. 13 is an example of a waveform of the electrical signal outputted from the 1st microphone 119 that is seriously distorted compared to the waveform of the electrical signal outputted from the 2nd microphone 123 according to the present disclosure.

In a case of executing a microphone-related function such as a call, voice recognition, voice recording and the like, the present disclosure can selectively use a microphone outputting an electrical signal of an acoustic characteristic suitable to the function, in consideration of a difference of acoustic characteristics of converted electrical signals outputted from the microphones 119, 123, and 124. The present disclosure can use the electrical signals outputted from the plurality of microphones 119, 123, and 124 adaptively to the microphone-related function. In other words, when the microphones 119, 123, and 124 output the electrical signals through the paths, respectively, the user device 100 can switch the path for receiving the electrical signal according to the function. In one example of FIG. 13, the electrical signal outputted from the 1st microphone 119 can be unsuitable to voice recognition since it has a bad acoustic quality due to distortion. On the contrary, the electrical signal outputted from the 2nd microphone 123 can be suitable to the voice recognition since it has a relatively good acoustic quality compared to the electrical signal outputted from the 1st microphone 119. For example, in comparison with the conventional art, in a case of voice recognition, a conventional user device can use an electrical signal outputted from a fixed and lower microphone for the voice recognition. However, when a user covers up a sound inlet hole of the lower microphone with a finger, the conventional user device can have difficulty with voice recognition. On the contrary, when the user covers up a sound inlet hole communicating with the lower microphone 119, the user device 10 can conclude that the electrical signal outputted from the lower microphone 119 is unsuitable to the voice recognition because of a bad acoustic quality, and can make use of electrical signals of excellent acoustic qualities of other microphones 123 and 124 for the voice recognition. In other words, the user device 10 and the operating method thereof can selectively use an electrical signal of a specific microphone of an excellent acoustic quality suitable to a function.

Figure 3:
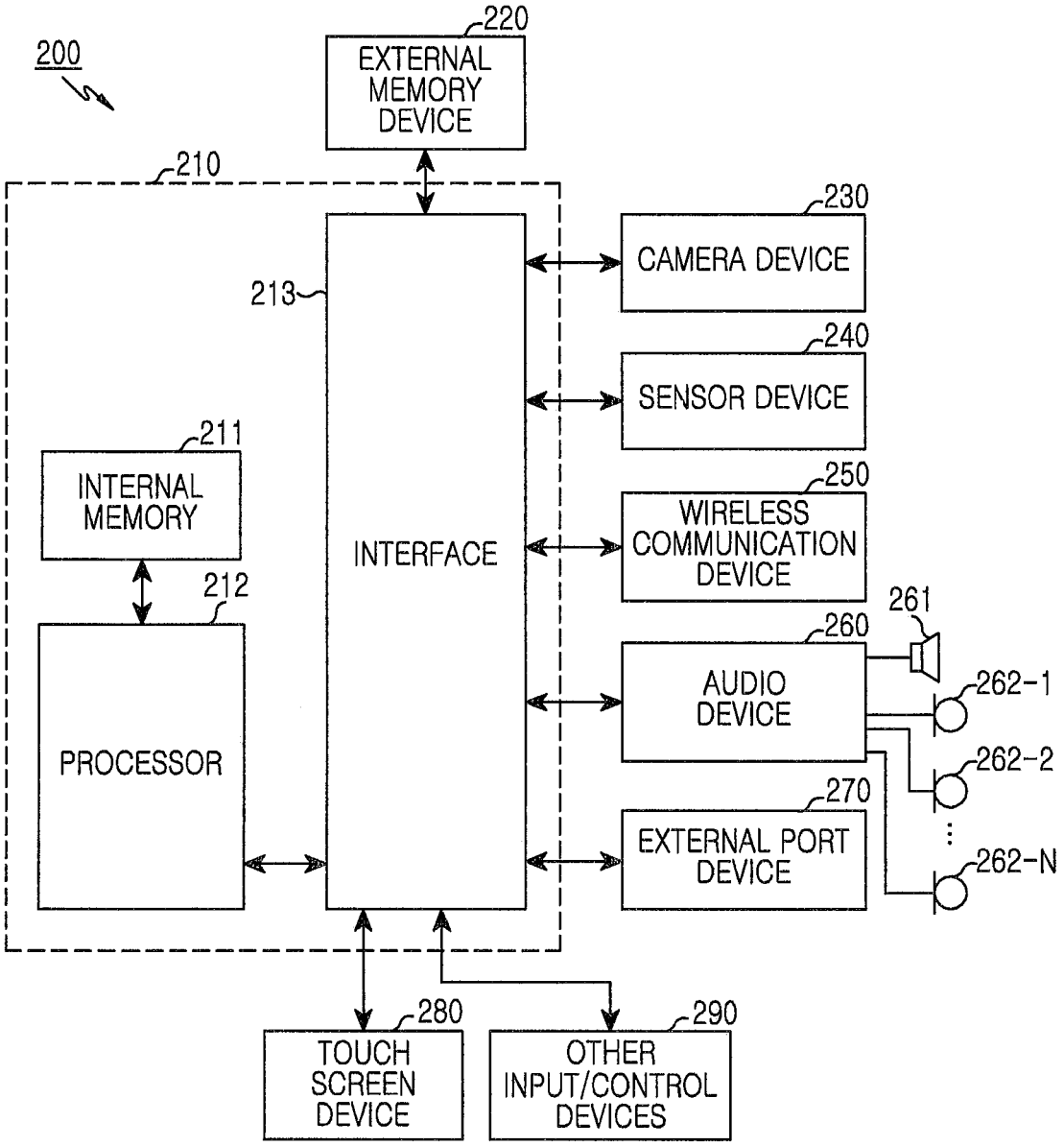
FIG. 3 is an example block diagram illustrating a construction of a user device according to the present disclosure.

FIG. 3 is an example block diagram illustrating a construction of a user device according to the present disclosure.

Referring to FIG. 3, the user device 200 can be a device such as a mobile phone, a mobile pad, a media player, a tablet computer, a handheld computer, or a Personal Digital Assistant (PDA). Also, the user device 200 can be any mobile terminal including a device having a combination of two or more functions among these devices.

The user device 200 can include a host device 210, an external memory device 220, a camera device 230, a sensor device 240, a wireless communication device 250, an audio device 260, an external port device 270, a touch screen device 280, and other input/control devices 290. The external memory device 220 and the external port device 270 can be constructed in plural.

The host device 210 can include an internal memory 211, one or more processors 212, and an interface 213. The internal memory 211, the one or more processors 212, and the interface 213 can be separate constituent elements or can be constructed in one or more integrated circuits.

The processor 212 can be configured to execute various software programs and perform various functions for the user device 200, and perform processing and control for voice communication, video communication, and data communication. Also, in addition to this general function, the processor 212 can be configured to execute a software program (such as an instruction set) stored in the internal memory 211 and/or external memory device 220 and perform various functions corresponding to the executed program. The processor 212 can be configured to interwork with the software programs stored in the internal memory 211 and/or external memory device 220 and perform various exemplary embodiments of the present disclosure. The processor 212 can include one or more Application Processor Units (APUs), Graphics Processor Units (GPUs), audio processor units, communication processor units and the like.

The application processor unit can be configured to drive an Operating System (OS) applied to the user device 200, a variety of functions, and the like, and can be a unit in which the functions of a core, a memory, a display system/controller, a multimedia encoding/decoding codec, a 2-Dimensional/3-Dimensional (2D/3D) accelerator engine, an Image Signal Processor (ISP), a camera, an audio, a modem, various high and low speed serial/parallel connectivity interfaces and the like are gathered as one chip. The application processor unit can be configured to drive the OS and applications, and can be a System-On-Chip (SOC) in which various functions of controlling a system device/interface are gathered as one chip.

The graphics processor unit can be configured to process a graphics related operation, and can be configured to take charge of image information processing, acceleration, signal conversion, screen output and the like. The graphics processor unit can be configured to solve a bottleneck phenomenon occurring due to a graphic work of the application processor unit, and can be configured to process a 2D or 3D graphic faster than the application processor unit.

The audio processor unit can be configured to process an audio related operation, and can be configured to change an audio signal of a digital or analog fatal through an audio effect or effect unit.

The communication processor unit can be configured to take charge of communication processing between the user device 200 and other devices and, when the user device 200 intends to use a communication function of a network, the communication processor unit can be configured to perform a function of establishing a connection between the user device 200 and the network.

The interface 213 can be configured to connect the host device 210 with various devices of the user device 200.

The external memory device 220 can include high-speed random access memories and/or non-volatile memories such as one or more magnetic disc storage devices, one or more optical storage devices and/or flash memories (such as NAND, NOR). The external memory device 220 can be configured to store software. The software can include an OS program, a communication program, a camera program, a graphic program, one or more application programs, a user interface program, a codec program and the like. The term of program may be expressed as a set of instructions, an instruction set, or a program. The communication program, the camera program, the graphic program, the one or more application programs, the user interface program, and the codec program can be configured to use various functions of the OS program through various Application Programming Interfaces (APIs).

The OS program can represent an embedded operating system such as WINDOWS, LINUX, Darwin, RTXC, UNIX, OS X, or VxWorks, and can include various software constituent elements controlling general system operation. Control of the general system operation can include memory management and control, storage hardware (device) control and management, power control and management and the like. Also, the OS program can perform even a function of making smooth communications between various hardware (devices) and software constituent elements (programs).

The communication program can be configured to enable a communication with a computer, a server, a user device and the like through the wireless communication device 250 or the external port device 270.

The camera program can include a camera-related software constituent element for enabling camera related processes and functions.

The graphic program can include various software constituent elements for providing and displaying a graphic on the touch screen device 280. The graphic program can create a graphic under an API basis such as Open Graphics Library (OpenGL), DirectX and the like, and can be configured to provide various filters which can apply various effects to an image. The term "graphic" can represent a text, a web page, an icon, a digital image, a video, an animation and the like.

The application program can include a browser, an e-mail, an instant message, word processing, keyboard emulation, an address book, a touch list, a widget, Digital Right Management (DRM), voice recognition, voice replication, a position determining function, a location-based service and the like.

The user interface program can include various software constituent elements related to a user interface. The user interface program can include information about how a state of the user interface is changed and whether the change of the state of the user interface is carried out in which conditions, and the like.

The codec program can include a software constituent element related to encoding and decoding of a video file.

The external memory device 220 can further include additional programs (such as instructions) in addition to the aforementioned programs. Also, various functions of the user device 200 can be executed by hardware including one or more stream processing and/or Application Specific Integrated Circuits (ASICs), software, and/or a combination of them.

The camera device 230 can be configured to perforin a camera function such as photo and video clip recording and the like. The camera device 230 can include a Charged Coupled Device (CCD), a Complementary Metal-Oxide Semiconductor (CMOS) or the like. Also, the camera device 230 can be configured to perform a change of a hardware construction, for example, lens shift, adjustment of an F-number of an iris, and the like according to a camera program executed by the processor 212.

Various constituent elements of the user device 200 can be connected with one another through one or more communication buses (not denoted by reference numerals) or stream lines (not denoted by reference numerals).

The sensor device 240 can include a motion sensor, an optical sensor, a temperature sensor and the like and enable various functions. For example, the motion sensor can be configured to sense a motion of the user device 200, and the optical sensor can be configured to sense ambient light.

The wireless communication device 250 can enable wireless communication, and can include a wireless frequency transmitter/receiver and an optical (such as infrared) transmitter/receiver. The wireless communication device 250 can include a module that includes at least one antenna, a Radio Frequency (RF) connector and the like. The wireless communication device 250 can be configured to operate through one of a Global System for Mobile Communication (GSM) network, an Enhanced Data GSM Environment (EDGE) network, a Code Division Multiple Access (CDMA) network, a Wireless-Code Division Multiple Access (W-CDMA) network, a Long Term Evolution (LTE) network, an Orthogonal Frequency Division Multiple Access (OFDMA) network, a Wireless Fidelity (Wi-Fi) network, a Wireless interoperability for Microwave Access (WiMAX) network, or/and a Bluetooth network according to a communication network.

The audio device 260 can be connected to a speaker 261 and a plurality of microphones 262-N to take charge of audio input and output of voice recognition, voice replication, digital recording, a call function and the like, and can include an audio amplifier. The audio device 260 can be configured to communicate with a user through the speaker 261 and the plurality of microphones 262-N. Also, the audio device 260 can be configured to receive a data signal from the host device 210, convert the received data signal into an electrical signal, and output the converted electrical signal through the speaker 261. The speaker 261 can be configured to convert the electrical signal into an audible frequency band and output the audible frequency band. The plurality of microphones 262-N can be configured to convert a sound wave forwarded from a person or other sound sources, into an electrical signal. Also, the audio device 260 can be configured to receive the electrical signals from the plurality of microphones 262-N, convert the received electrical signals into audio data signals, and transmit the converted audio data signals to the host device 210.

In an embodiment, the audio device 260 can be configured to analyze acoustic characteristics of electrical signals outputted form the plurality of microphones 262-N, and can be configured to electrically connect a specific microphone and the host device 210 according to the analysis result. The audio device 260 can be configured to compare the acoustic characteristics of the electrical signals from the plurality of microphones 262-N with a reference acoustic characteristic suitable to a function, and can be configured to electrically connect the specific microphone outputting the electrical signal satisfying the reference acoustic characteristic with the host device 210. This acoustic characteristic can include at least one of frequency, volume, echo, clipping, and a Root Mean Square (RMS) level.

In an embodiment, the audio device 260 can include a permanent operation adaptive filter and a periodic operation adaptive filter for canceling a bad component such as an echo, a noise and/or the like from electrical signals outputted from the plurality of microphones 262-N. The electrical signal passing the permanent operation adaptive filter can be outputted to the host device 210. If the performance of the permanent operation adaptive filter falls equal to or less than a predetermined level or if a preset period arrives, the audio device 260 can be configured to detect the remnant bad components (such as non-linear echo components) not canceled by the permanent operation adaptive filter and the remnant bad components not canceled by the periodic operation adaptive filter, and compare the detected remnant bad components with one another. Here, if the remnant bad components not canceled by the permanent operation adaptive filter exceed a reference value, the audio device 260 can be configured to determine that the performance of the permanent operation adaptive filter is deteriorated. According to the comparison result, the audio device 260 can be configured to switch electrical connection paths between the plurality of microphones 262-N and the permanent operation adaptive filter and periodic operation adaptive filter, and guarantee the performance of bad component cancelation of the permanent operation adaptive filter.

The external port device 270 can be configured to directly connect the user device 200 with other user devices, or indirectly connect the user device 200 with other user devices through a network (such as the Internet, an intranet, a wireless LAN and the like).

The touch screen device 280 can be configured to provide an input and output interface between the user device 200 and a user. The touch screen device 280 can be configured to apply a touch-sensitive technology, and forward a user's touch input to the host device 210 and show to the user visual information provided from the host device 210, for example, a text, a graphic, a video and the like. The touch screen device 280 can include a display displaying an image. The display can be one of an Electro Wetting Display (EWD), Electronic paper (E-Paper), a Plasma Display Panel (PDP), a Liquid Crystal Display (LCD), an Organic Light Emitting Diode (OLED), and an Active Matrix Organic Light Emitting Diode (AMOLED). Also, the touch screen device 280 can include a device receiving a touch. The device can be one of a stylus-pen digitizer, a capacitive overlay touch panel, a resistance overlay touch panel, a surface acoustic wave touch panel, and an infrared beam touch panel.

The other input/control devices 290 can include an up/down button for volume control. In addition to this, the other input/control devices 290 can include at least one of a push button given a specific function, a locker button, a rocker switch, a thumb-wheel, a dial, a stick, and a pointer device such as a stylus and the like.

Figure 4:
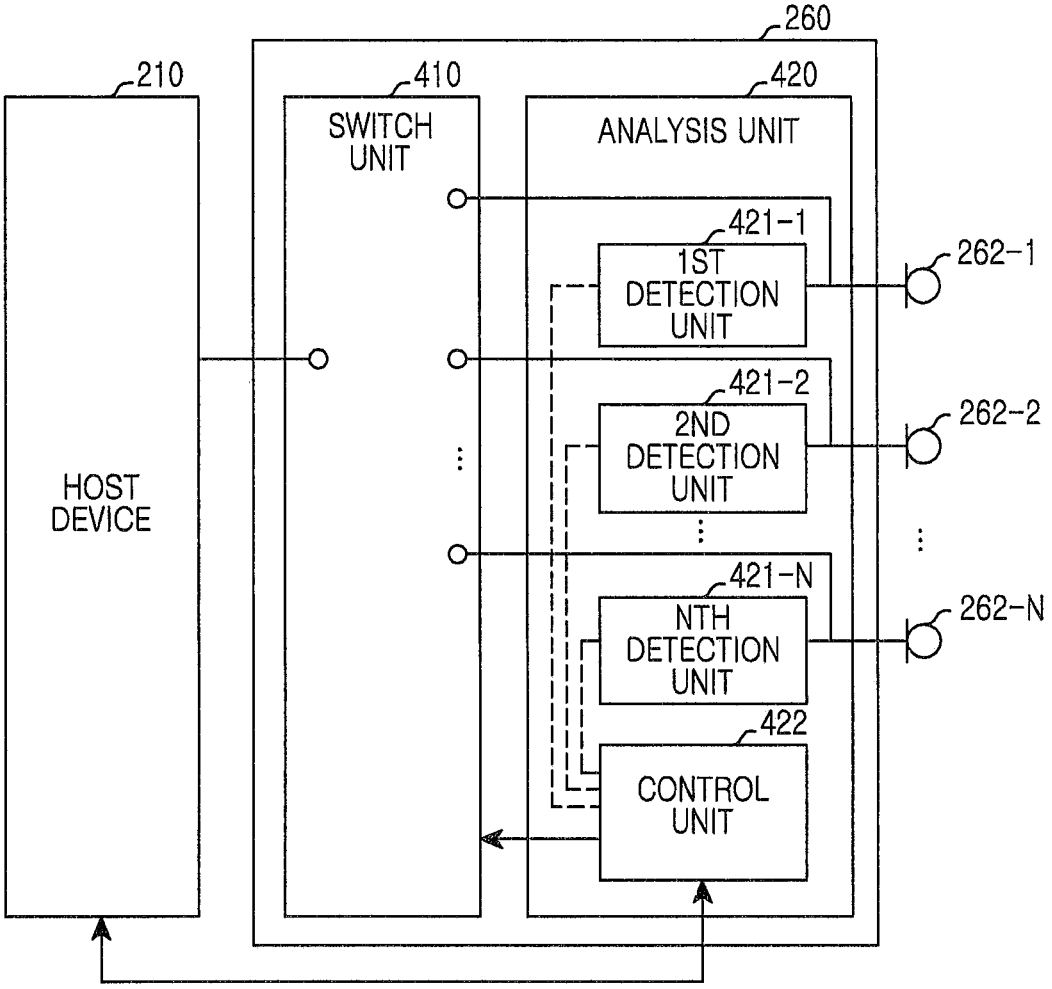
FIG. 4 is an example block diagram illustrating a construction of a microphone-related function according to the present disclosure.

FIG. 4 is an example block diagram illustrating a construction of a microphone-related function according to the present disclosure.

Referring to FIG. 4, the audio device 260 can be configured to output an electrical signal suitable to a function among electrical signals outputted from the plurality of microphones 262-N, to the host device 210. The audio device 260 can be configured to switch a path of a microphone outputting an electrical signal which is advantageous for execution of a function of the host device 210. This function can be a call, voice recognition, voice recording and the like.

In an embodiment, the audio device 260 can be configured to detect RMS values of the electrical signals outputted from the microphones 119, 123, and 124, and can electrically connect the microphone outputting the electrical signal of the RMS value suitable to voice recognition with the host device 210 while not electrically connecting the remnant microphones and not outputting the electrical signal with the host device 210. The electrical signal outputted from the microphone electrically connected with the host device 210 executing the voice recognition can have a signal strength (such as −44 dB) suitable to the voice recognition. In an embodiment, the electrical signals outputted from the microphones not electrically connected with the host device 210 can be unsuitable to the voice recognition since they have a too less volume or a too large sound or clipping.

In an embodiment, the audio device 260 can be configured to detect RMS values of the electrical signals outputted from the microphones 119, 123, and 124, and can electrically connect the microphone outputting the electrical signal of the RMS value suitable to voice recording with the host device 210 while not electrically connecting the remnant microphones and not outputting the electrical signal with the host device 210. The electrical signal outputted from the microphone electrically connected with the host device 210 executing the voice recording can be a saturated signal suitable to the voice recording. In an embodiment, the electrical signals outputted from the microphones not electrically connected with the host device 210 can be unsuitable to the voice recording since they are unsaturated signals.

The audio device 260 can include a switch unit 410 and an analysis unit 420. The analysis unit 420 can be configured to analyze acoustic characteristics of electrical signals outputted from the plurality of microphones 262-N. According to the analysis result of the analysis unit 420, the switch unit 410 can be configured to electrically connect a specific microphone and the host device 210. This acoustic characteristic can be related to at least one of frequency, volume, echo, clipping, and saturation.

The host device 210 can be configured to execute a related function using an electrical signal outputted from a specific microphone connected with the host device 210 by the switch unit 410.

The analysis unit 420 of the audio device 260 can include a plurality of detection units 421-N and a control unit 422. The plurality of detection units 421-N can be electrically connected to the plurality of microphones 262-N respectively on a point-to-point basis, and can be configured to detect acoustic characteristics of electrical signals outputted from the plurality of microphones 262-N. The control unit 422 can be configured to compare the acoustic characteristics of the electrical signals outputted from the plurality of detection units 421-N with a reference acoustic characteristic suitable to a function, and control the switch unit 410 to electrically connect a specific microphone outputting an electrical signal satisfying the reference acoustic characteristic with the host device 210.

If initiating a microphone-related function, the host device 210 can be configured to provide the control unit 422 of the audio device 260 with information about a microphone previously designated to the function and a reference acoustic characteristic suitable to the function. The control unit 422 of the audio device 260 can be configured to control the switch unit 410 to preferentially connect the microphone previously designated to the function to the host device 210, and the host device 210 can be configured to preferentially execute the function using an electrical signal outputted from the microphone previously designated to the function.

The control unit 422 of the audio device 260 can be configured to preferentially operate the detection unit electrically connected to the microphone previously designated to the function. Next, if an acoustic characteristic of an electrical signal outputted from the detection unit electrically connected to the microphone previously designated to the function does not satisfy the reference acoustic characteristic, the control unit 422 of the audio device 260 can be configured to operate the remnant detection units. The control unit 422 of the audio device 260 can be configured to permanently operate the detection unit electrically connected to the microphone previously designated to the function, and periodically operate the remnant detection units.

If a specific microphone outputting an electrical signal satisfying the reference acoustic characteristic is confirmed from the detection result of the remnant detection units, the control unit 422 of the audio device 260 can be configured to control the switch unit 410 to switch from the microphone previously designated to the function to the specific microphone. If the specific microphone outputting the electrical signal satisfying the reference acoustic characteristic is not confirmed from the detection result of the remnant detection units, the control unit 422 of the audio device 260 can be configured to maintain an electrical connection between the microphone previously designated to the function and the host device 210. Even next, the control unit 422 of the audio device 260 can be configured to control the switch unit 410 according to the aforementioned operation to switch a path of a microphone electrically connected with the host device 210.

In a case of switching the path of the microphone electrically connected with the host device 210, the control unit 422 of the audio device 260 can be configured to delay an electrical disconnection between a microphone being an electrical disconnection target and the host device 210 during a predetermined time, and control the switch unit 410 to electrically connect a microphone being an electrical connection target with the host device 210. The control unit 422 of the audio device 260 can be configured to mix an electrical signal outputted from the microphone being the electrical disconnection target and an electrical signal outputted from the microphone being the electrical connection target and output the mixing result to the host device 210. After the delay time, the control unit 422 of the audio device 260 can be configured to release the electrical connection between the microphone being the electrical disconnection target and the host device 210, and output to the host device 210 only an electrical signal of the other microphone maintaining electrical connection. FIG. 14 is an example table showing weights applied to electrical signals when mixing the electrical signals outputted from two microphones during a delay time according to the present disclosure. Referring to FIG. 14, during the delay time, a weight applied to an electrical signal of an 'A' microphone being an electrical disconnection target can be gradually decreased and a weight applied to an electrical signal of a 'B' microphone being an electrical connection target can be relatively increased. This can prevent sudden switching of a microphone path, and achieve smooth switching between electrical signals.

Figure 5:
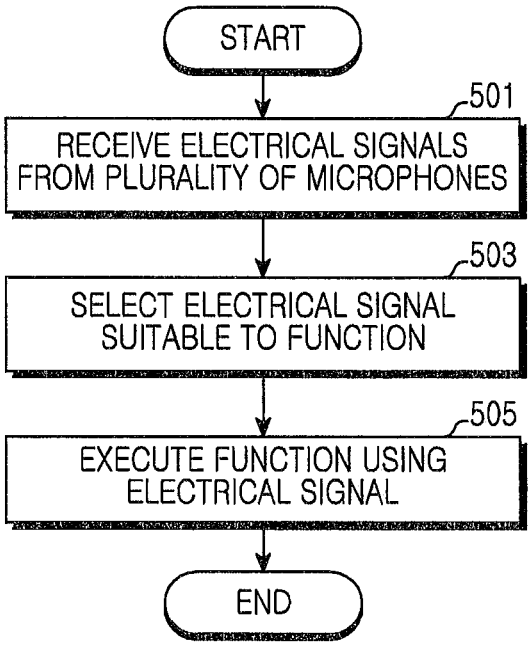
FIG. 5 is an example flowchart illustrating an operation of a user device according to the present disclosure.

FIG. 5 is an example flowchart illustrating an operation of a user device according to the present disclosure.

Referring to FIG. 5, in step 501, the user device 200 can receive electrical signals from a plurality of microphones.

In step 503, the user device 200 can select an electrical signal suitable to a function among the received electrical signals.

In step 505, the user device 200 can execute the function using the selected electrical signal. This function can be a call, voice recognition, voice recoding and the like.

Figure 6:
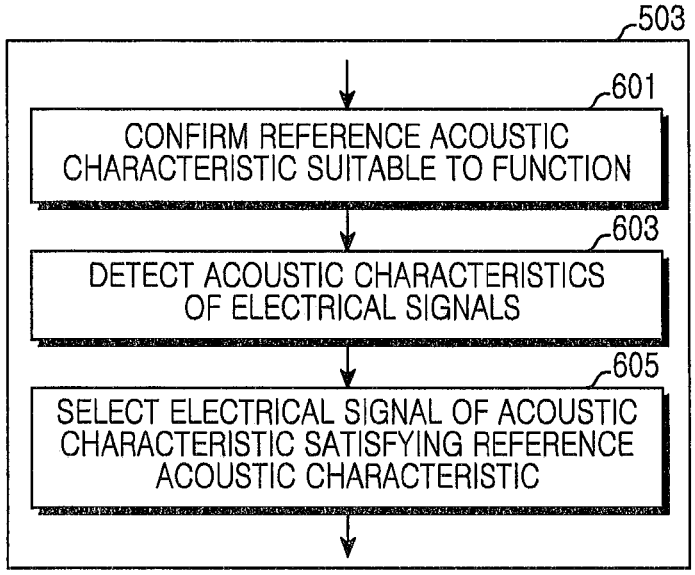
FIG. 6 is an example flowchart illustrating step 503 of FIG. 5 according to the present disclosure.

FIG. 6 is an example flowchart illustrating step 503 of FIG. 5 according to the present disclosure.

Referring to FIG. 6, in step 601, the user device 200 can confirm a reference acoustic characteristic suitable to a function.

In step 603, the user device 200 can detect acoustic characteristics of electrical signals. This acoustic characteristic can be related to at least one of frequency, volume, echo, clipping and saturation.

In step 605, the user device 200 can select the electrical signal of the acoustic characteristic satisfying the reference acoustic characteristic, among the detected electrical signals.

Figure 7:
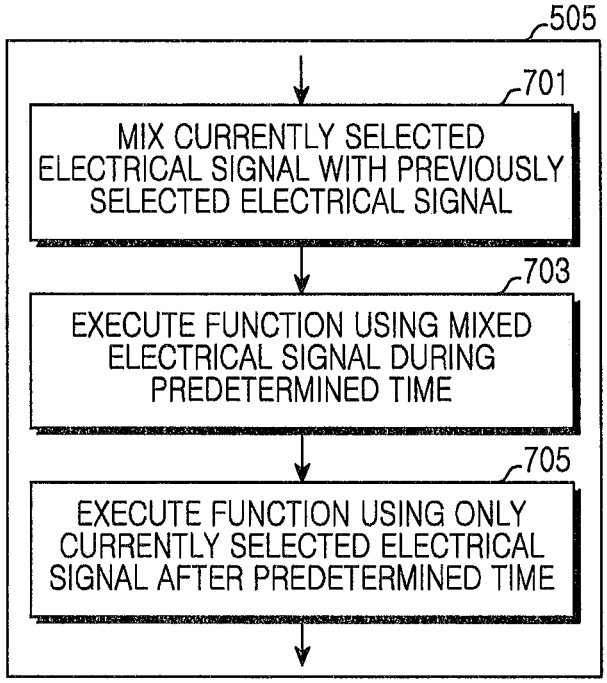
FIG. 7 is an example flowchart illustrating step 505 of FIG. 5 according to the present disclosure.

FIG. 7 is an example flowchart illustrating step 505 of FIG. 5 according the present disclosure.

Referring to FIG. 7, in step 701, the user device 200 can mix a currently selected electrical signal and a previously selected electrical signal.

In step 703, the user device 200 can execute a function using the mixed electrical signal during a predetermined time. A method of mixing electrical signals of two microphones during a predetermined time has been described before with reference to FIG. 14.

In step 705, after the predetermined time, the user device 200 can execute the function using only the currently selected electrical signal.

Figure 8:
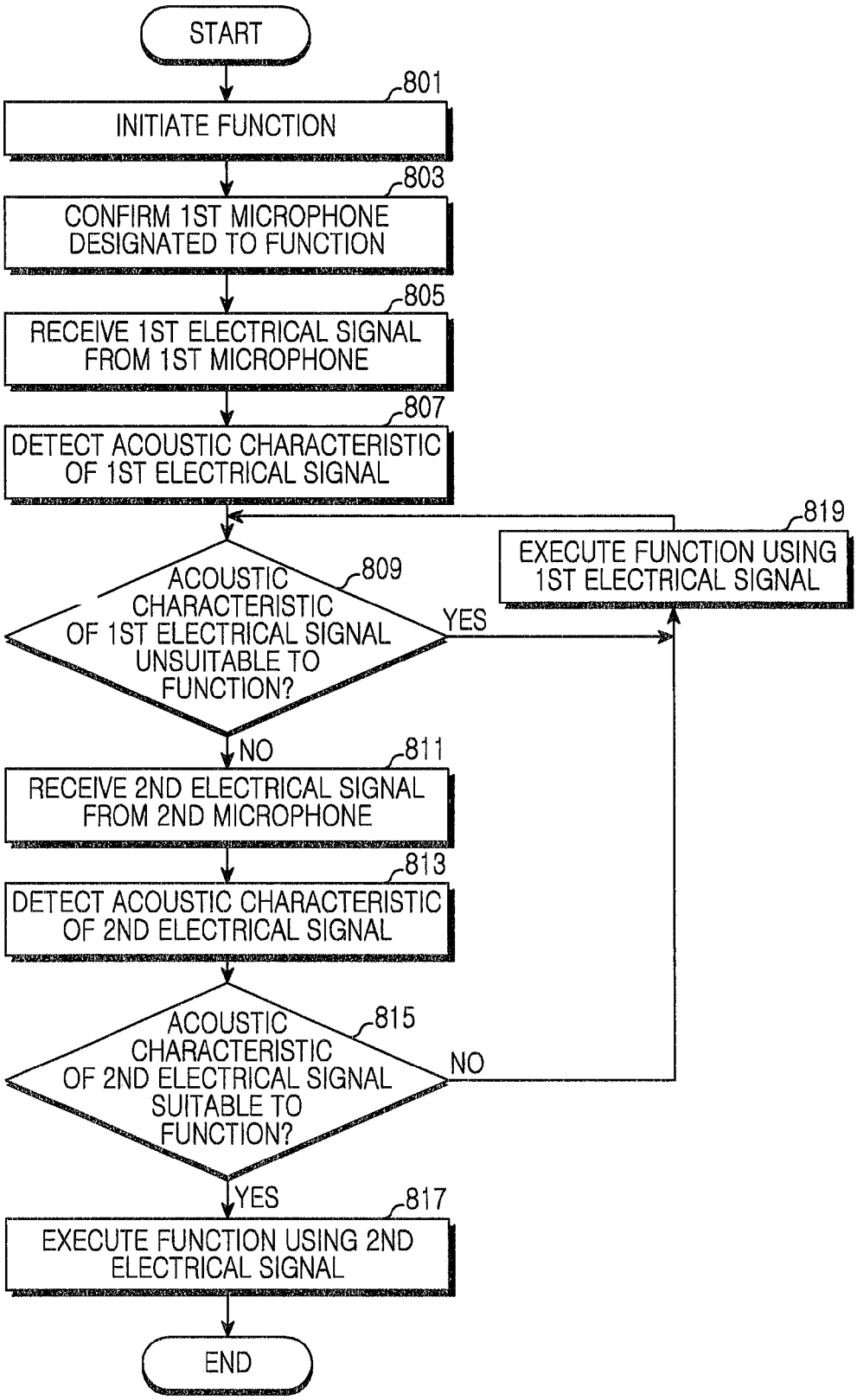
FIG. 8 is an example flowchart illustrating an operation of a user device according to the present disclosure.

FIG. 8 is an example flowchart illustrating an operation of a user device according to the present disclosure.

Referring to FIG. 8, in step 801, the user device 200 can initiate a function.

In step 803, the user device 200 can confirm a 1st microphone designated to the function.

In step 805, the user device 200 can receive a 1st electrical signal from the 1st microphone.

In step 807, the user device 200 can detect an acoustic characteristic of the 1st electrical signal.

In step 809, the user device 200 can determine if the acoustic characteristic of the 1st electrical signal is suitable to the function.

If the acoustic characteristic of the 1st electrical signal is suitable to the function, in operation 819, the user device 200 can execute the function using the 1st electrical signal. In an embodiment, if the acoustic characteristic of the 1st electrical signal is unsuitable to the function, in step 811, the user device 200 can receive a 2nd electrical signal from a 2nd microphone. In step 813, the user device 200 can detect an acoustic characteristic of the 2nd electrical signal.

In step 815, the user device 200 can determine if the acoustic characteristic of the 2nd electrical signal is suitable to the function. If the acoustic characteristic of the 2nd electrical signal is unsuitable to the function, in step 819, the user device 200 can use the 1st electrical signal for the function as it stands. In an embodiment, if the acoustic characteristic of the 2nd electrical signal is suitable to the function, in step 817, the user device 200 can execute the function using the 2nd electrical signal.

Figure 9:
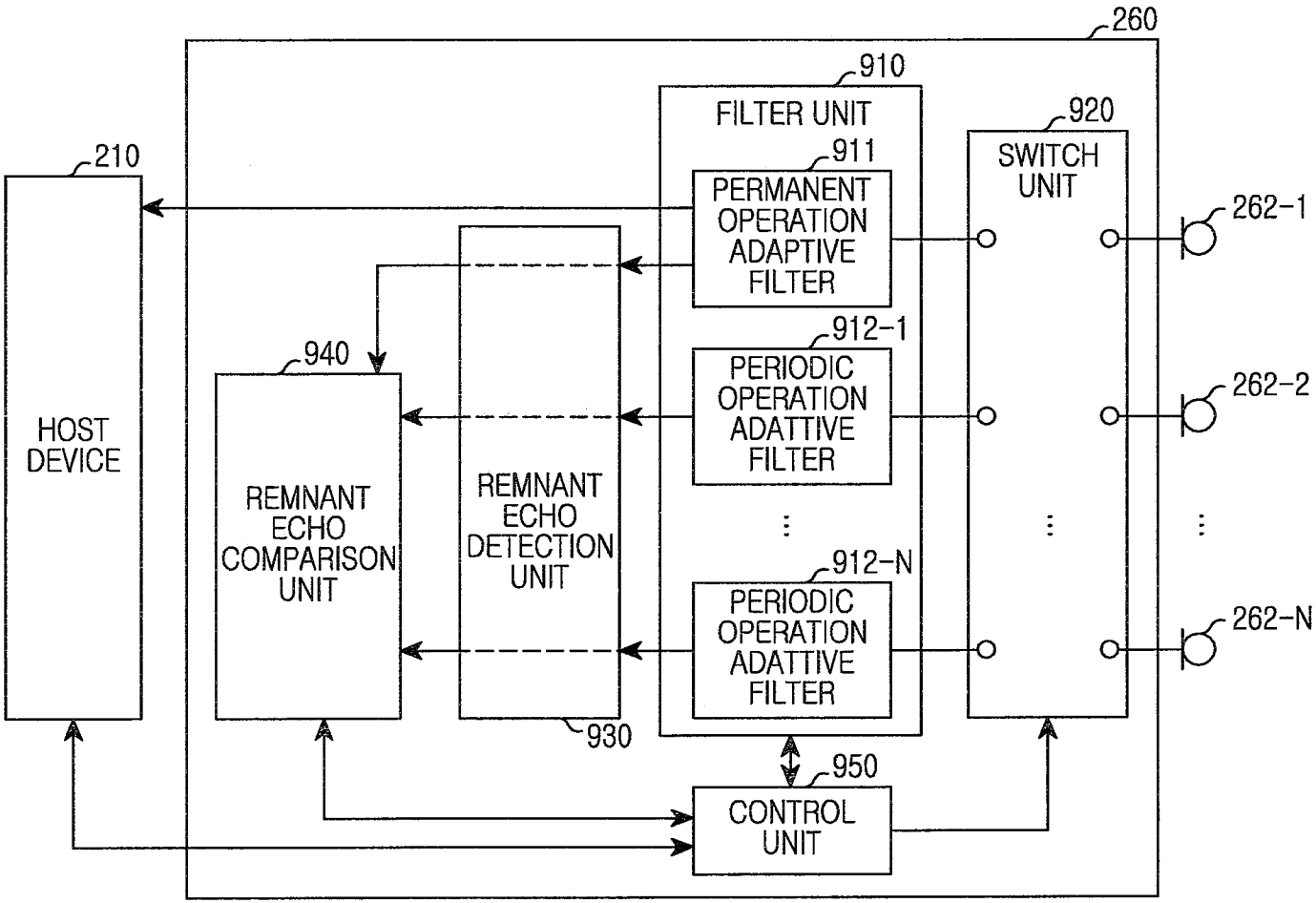
FIG. 9 is an example block diagram illustrating a construction of a microphone-related function according to the present disclosure.

FIG. 9 is an example block diagram illustrating a construction of a microphone-related function according to the present disclosure.

Referring to FIG. 9, the audio device 260 can include a filter unit 910, a switch unit 920, a remnant echo detection unit 930, a remnant echo comparison unit 940, and a control unit 950. The host device 210 can be configured to execute a function using a microphone-related electrical signal outputted from the audio device 260.

The filter unit 910 can include a permanent operation adaptive filter 911 and periodic operation adaptive filters 912-N. The permanent operation adaptive filter 911 and the periodic operation adaptive filters 912-N can be configured to cancel echoes from electrical signals outputted from the plurality of microphones 262-N. The permanent operation adaptive filter 911 and the periodic operation adaptive filters 912-N can be electrically connected with respective microphones 262-N on a point-to-point basis under the operation of the switch unit 920. The permanent operation adaptive filter 911 and the periodic operation adaptive filters 912-N can be electrically connected with the remnant echo detection unit 930. The permanent operation adaptive filter 911 can be electrically connected with the host device 210.

The switch unit 920 can be configured to switch an electrical connection path between the plurality of microphones 262-N and the filter unit 920 under the control of the control unit 950.

The remnant echo detection unit 930 can be configured to detect the remnant echoes (such as non-linear echo components) not canceled by the permanent operation adaptive filter 911 and the remnant echoes not canceled by the periodic operation adaptive filters 912-N.

The remnant echo comparison unit 940 can be configured to compare the remnant echoes not canceled by the permanent operation adaptive filter 911 with the remnant echoes not canceled by the periodic operation adaptive filters 912-N.

The control unit 950 can be configured to control the switch unit 920 to switch electrical connection paths between the filter unit 910 and the plurality of microphones 262-N according to the comparison result of the remnant echo comparison unit 940.

For example, when a call function is initiated, the control unit 950 can be configured to confirm a 1st microphone 262-1 previously designated to the call function. The control unit 950 can be configured to acquire from the host device 210 information about microphones previously designated by function. Next, the control unit 950 can be configured to control the switch unit 920 to electrically connect the permanent operation adaptive filter 911 and the 1st microphone 262-1 and electrically connect the 1st periodic operation adaptive filter 912-1 and the 2nd microphone 262-2. The permanent operation adaptive filter 911 can be configured to pass an electrical signal outputted from the 1st microphone 262-1 and filter out an echo of a linear component from the electrical signal, and can be configured to output the electrical signal filtering out the echo of the linear component to the host device 210. The host device 210 can be configured to execute the call function using the electrical signal passing through the permanent operation adaptive filter 911. Here, if an echo cancelation performance of the permanent operation adaptive filter 911 falls equal to or less than a predetermined level or if a preset period arrives, the control unit 950 can be configured to operate the remnant echo detection unit 930 and the remnant echo comparison unit 940. If the remnant bad components not canceled by the permanent operation adaptive filter 911 exceed a reference value, the control unit 950 can be configured to determine that the performance of the permanent operation adaptive filter 911 is deteriorated. The remnant echo detection unit 930 can be configured to detect a 1st remnant echo of a non-linear component not canceled by the permanent operation adaptive filter 911 and a 2nd remnant echo of a non-linear component not canceled by the 1st periodic operation adaptive filter 912-1. Also, the remnant echo comparison unit 940 can be configured to compare the 1st remnant echo detected from the permanent operation adaptive filter 911 and the 2nd remnant echo detected from the 1st periodic operation adaptive filter 912-1.

If the 1st remnant echo is greater than the 2nd remnant echo, the control unit 950 can be configured to perform the following operation. The control unit 950 can be configured to control the switch unit 920 to release an existing electrical connection between the permanent operation adaptive filter 911 and the 1st microphone 262-1 and electrically connect the permanent operation adaptive filter 911 and the 2nd microphone 262-2, and release an existing electrical connection between the 1st periodic operation adaptive filter 912-1 and the 2nd microphone 262-2 and electrically connect the 1st periodic operation adaptive filter 912-1 and the 1st microphone 262-1. As a result, the permanent operation adaptive filter 911 can have better performance when canceling an echo from an electrical signal outputted from the switched 2nd microphone 262-2 than when canceling an echo from an electrical signal outputted from the previous 1st microphone 262-1. In other words, in a case of using the 2nd microphone 262-2, the permanent operation adaptive filter 911 can better decrease the remnant echoes included in the electrical signal outputted to the host device 210 than before. An electrical signal of a less echo component can be advantageous for execution of a function of the host device 210.

In an embodiment, if the 1st remnant echo is less than the 2nd remnant echo, the control unit 950 can be configured to maintain the electrical connection between the permanent operation adaptive filter 911 and the 1st microphone 262-1, and maintain the electrical connection between the 1st periodic operation adaptive filter 912-1 and the 2nd microphone 262-2.

If there is switching of an electrical connection path between the plurality of microphones 262-N and the filter unit 910, the control unit 950 can be configured to concurrently operate the permanent operation adaptive filter 911 and the periodic operation adaptive filters 912-N, and control the switch unit 920 to delay switching of an electrical connection path until an electrical signal passing the permanent operation adaptive filter 911 and electrical signals passing the periodic operation adaptive filters 912-N are similar equal to or more than a predetermined level. This can reduce a difference of the echo cancelation performance of the permanent operation adaptive filter 911 resulting from sudden switching of a microphone path, and lead to smooth switching between electrical signals outputted to the host device 210.

In an embodiment, an electronic device can include a plurality of microphones, an analysis unit, a switch unit, and a host device. The microphones be configured to convert sounds into electrical signals. The analysis unit be configured to analyze acoustic characteristics of the electrical signals outputted from the plurality of microphones. The switch unit be configured to electrically connect a specific microphone and a host device according to the analysis result of the analysis unit. The host device be configured to execute a function using an electrical signal outputted from the specific microphone.

In an embodiment, the analysis unit can include a plurality of detection units electrically connected to the plurality of microphones respectively on a point-to-point basis, and detecting the acoustic characteristics of the electrical signals outputted from the plurality of microphones, and a control unit be configured to compare the acoustic characteristics outputted from the plurality of detection units and a reference acoustic characteristic suitable to the function. The control unit can be configured to control the switch unit to electrically connect the specific microphone outputting the electrical signal satisfying the reference acoustic characteristic with the host device.

In an embodiment, the control unit can be configured to control the switch unit to preferentially connect a microphone previously designated to the function to the host device.

In an embodiment, the control unit can be configured to receive information about the reference acoustic characteristic suitable to the function and the microphone previously designated to the function, from the host device.

In an embodiment, if the acoustic characteristic of the electrical signal outputted from the detection unit electrically connected to the microphone previously designated to the function does not satisfy the reference acoustic characteristic, the control unit can be configured to operate the remnant detection units.

In an embodiment, if the specific microphone outputting the electrical signal satisfying the reference acoustic characteristic is confirmed from the detection result of the remnant detection units, the control unit can be configured to control the switch unit to switch from the microphone previously designated to the function to the specific microphone.

In an embodiment, the control unit can be configured to permanently operate the detection unit electrically connected to the specific microphone, and periodically operate the remnant detection units.

In an embodiment, the control unit can be configured to control the switch unit to delay an electrical disconnection between a previous microphone and the host device during a predetermined time. Also, the control unit can be configured to mix an electrical signal of the previous microphone and the electrical signal of the specific microphone during the delay time and output the mixing result to the host device.

In an embodiment, the acoustic characteristic can be related to at least one of frequency, volume, echo, clipping, and saturation.

In an embodiment, an electronic device can include a 1st microphone and a 2nd microphone, a filter unit including a permanent operation adaptive filter and a periodic operation adaptive filter, a switch unit, a detection unit, a comparison unit, a control unit, and a host device. The 1st microphone and 2nd microphone be configured to convert sounds into electrical signals. The permanent operation adaptive filter and periodic operation adaptive filter are electrically connected with the 1st microphone and 2nd microphone respectively on a point-to-point basis and can be configured to cancel echoes from electrical signals outputted from the 1st microphone and 2nd microphone. The switch unit be configured to switch an electrical connection path between the filter unit and the 1st microphone and 2nd microphone. The detection unit can be configured to detect a 1st remnant echo not canceled by the permanent operation adaptive filter and a 2nd remnant echo not canceled by the periodic operation adaptive filter. The comparison unit be configured to compare the 1st remnant echo and the 2nd remnant echo. The control unit be configured to control the switch unit according to the comparison result of the comparison unit. The host device be configured to execute a function using an electrical signal passing the permanent operation adaptive filter.

In an embodiment, if the 1st remnant echo exceeds a reference value or if a period arrives, the control unit can be configured to operate the detection unit and the comparison unit.

In an embodiment, the control unit can be configured to control the switch unit to preferentially connect a microphone previously designated to the function to the permanent operation adaptive filter.

In an embodiment, if the 1st remnant echo is greater than the 2nd remnant echo, the control unit can be configured to control the switch unit to switch an electrical connection path between the filter unit and the 1st microphone and 2nd microphone.

In an embodiment, if the 1st remnant echo is equal to or is less than the 2nd remnant echo, the control unit can be configured to maintain an existing electrical connection path between the filter unit and the 1st microphone and 2nd microphone.

In an embodiment, if there is switching of an electrical connection path between the filter unit and the 1st microphone and 2nd microphone, the control unit can be configured to concurrently operate the permanent operation adaptive filter and the periodic operation adaptive filter, and control the switch unit to delay the switching of the electrical connection path until an electrical signal passing the permanent operation adaptive filter and an electrical signal passing the periodic operation adaptive filter become similar to, equal to, or more than a predetermined level.

In an embodiment, a method for processing an audio can include the operations of receiving electrical signals from a plurality of microphones, selecting an electrical signal suitable to a function among the received electrical signals, and executing the function using the selected electrical signal.

In an embodiment, the operation of selecting the electrical signal suitable to the function can include the operations of confirming a reference acoustic characteristic suitable to the function, detecting acoustic characteristics of the received electrical signals, and selecting the electrical signal of the acoustic characteristic satisfying the reference acoustic characteristic among the received electrical signals.

In an embodiment, executing the function using the selected electrical signal can include mixing the selected electrical signal and an electrical signal selected prior to the selected electrical signal, during a predetermined time, executing the function using the mixed electrical signal, and, after the predetermined time, executing the function using only the selected electrical signal.

In an embodiment, the acoustic characteristic can be related to at least one of frequency, volume, echo, clipping, and saturation.

In an embodiment, a method for processing an audio signal can include initiating a function, receiving a 1st electrical signal from a 1st microphone designated to the function, detecting an acoustic characteristic of the 1st electrical signal. The method can also include that if the acoustic characteristic of the 1st electrical signal is suitable to the function, executing the function using the 1st electrical signal, and if the acoustic characteristic of the 1st electrical signal is unsuitable to the function, receiving a 2nd electrical signal from a 2nd microphone. The method can further include detecting an acoustic characteristic of the 2nd electrical signal. If the acoustic characteristic of the 2nd electrical signal is suitable to the function, executing the function using the 2nd electrical signal, and, if the acoustic characteristic of the 2nd electrical signal is unsuitable to the function, executing the function using the 1st electrical signal.

Methods according to embodiments disclosed in claims of the present disclosure and/or the specification thereof can be implemented in a form of hardware, software, or a combination of hardware and software.

In a case of implementing in the software form, a computer-readable storage medium storing one or more programs (i.e., software modules) can be provided. One or more programs stored in the computer-readable storage medium can be constructed to be executable by one or more processors within an electronic device. One or more programs can include instructions for enabling the electronic device to execute the methods according to the exemplary embodiments disclosed in the claims of the present disclosure and/or the specification thereof.

These programs (i.e., software modules or software) can be stored in a Random Access Memory (RAM), a nonvolatile memory including a flash memory, a Read Only Memory (ROM), an Electrically Erasable Programmable ROM (EEPROM), a magnetic disc storage device, a Compact Disk ROM (CD-ROM), a Digital Versatile Disc (DVD) or an optical storage device of other form, and a magnetic cassette. Alternately, the programs can be stored in a memory constructed by a combination of some or all of them. Also, each construction memory may be included in plural.

A user device and an operating method thereof according to the present disclosure can be configured to execute a function using an electrical signal suitable to the function among electrical signals outputted from a plurality of microphones. For example, in a case of voice recognition, a conventional user device be configured to make use of an electrical signal outputted from a fixed and lower microphone for the voice recognition. However, when a user covers up a sound inlet hole of the lower microphone with a finger, the conventional user device can have difficulty in the voice recognition. In an embodiment, when the user covers up a sound inlet hole communicating with a lower microphone, the user device according to the present disclosure can be configured to conclude that the electrical signal outputted from the lower microphone is unsuitable to the voice recognition because having a bad acoustic quality, and make use of electrical signals of other microphones for the voice recognition. The user device and the operation method thereof according to the present disclosure can be configured to selectively make use of an electrical signal of an excellent acoustic quality suitable to a function among electrical signals outputted from a plurality of microphones. Accordingly, the user device and the operation method thereof according to the present disclosure can be configured to maintain a quality of a microphone-related function according to a situation of the user device, and can increase a satisfaction of use.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An electronic device comprising:

a plurality of microphones configured to convert sounds into electrical signals;

an analysis processor configured to analyze acoustic characteristics of the electrical signals;

a switch configured to electrically connect a specific microphone and a host device according to the analysis result of the analysis unit; and the host device configured to execute a function using the specific microphone, wherein the analysis unit comprises:

a plurality of detection units electrically connected to the plurality of microphones respectively on a point-to-point basis, and configured to detect the acoustic characteristics of the electrical signals outputted from the plurality of microphones; and a control unit configured to compare the acoustic characteristics and a reference acoustic characteristic suitable to the function, to select an electrical signal suitable to the reference acoustic characteristic among the electrical signals based on a result of the comparison, and to control the switch unit to electrically connect the specific microphone corresponding to the electrical signal with the host device.

2. The electronic device of claim 1, wherein the control unit is configured to control the switch unit to preferentially connect a microphone previously designated to the function to the host device.

3. The electronic device of claim 2, wherein the control unit is configured to receive information about the reference acoustic characteristic suitable to the function and the microphone previously designated to the function, from the host device.

4. The electronic device of claim 2, wherein, if the acoustic characteristic of the electrical signal outputted from the detection unit electrically connected to the microphone previously designated to the function does not satisfy the reference acoustic characteristic, the control unit is configured to operate the remnant detection units.

5. The electronic device of claim 4, wherein, if the specific microphone outputting the electrical signal satisfying the reference acoustic characteristic is confirmed from the detection result of the remnant detection units, the control unit is configured to control the switch unit to switch from the microphone previously designated to the function to the specific microphone.

6. The electronic device of claim 1, wherein the control unit is configured to:

permanently operate the detection unit electrically connected to the specific microphone, and periodically operate the remnant detection units.

7. The electronic device of claim 1, wherein the control unit is configured to:

control the switch unit to delay an electrical disconnection between a previous microphone and the host device during a predetermined time, mix an electrical signal of the previous microphone and the electrical signal of the specific microphone during the delay time, and output the mixing result to the host device.

8. The electronic device of claim 1, wherein the acoustic characteristic is related to at least one of frequency, volume, echo, clipping, or saturation.

9. An electronic device comprising:

A first microphone and a second microphone configured to convert sounds into electrical signals;

a filter unit comprising a permanent operation adaptive filter and a periodic operation adaptive filter, the permanent operation adaptive filter and periodic operation adaptive filter being electrically connected with the first microphone and the second microphone respectively on a point-to-point basis and configured to cancel echoes from electrical signals outputted from the first microphone and the second microphone;

a switch unit configured to switch an electrical connection path between the filter unit and the first microphone and the second microphone;

a detection unit configured to detect a first remnant echo not canceled by the permanent operation adaptive filter and a second remnant echo not canceled by the periodic operation adaptive filter;

a comparison unit configured to compare the first remnant echo and the second remnant echo;

a control unit configured to control the switch unit according to the comparison result of the comparison unit; and a host device configured to execute a function using an electrical signal passing the permanent operation adaptive filter.

10. The electronic device of claim 9, wherein, if the first remnant echo exceeds a reference value or if a period arrives, the control unit is configured to operate the detection unit and the comparison unit.

11. The electronic device of claim 9, wherein the control unit is configured to control the switch unit to preferentially connect a microphone previously designated to the function to the permanent operation adaptive filter.

12. The electronic device of claim 9, wherein, if the first remnant echo is greater than the second remnant echo, the control unit is configured to control the switch unit to switch an electrical connection path between the filter unit and the first microphone and the second microphone.

13. The electronic device of claim 12, wherein, if the first remnant echo is equal to or is less than the second remnant echo, the control unit is configured to maintain an existing electrical connection path between the filter unit and the first microphone and the second microphone.

14. The electronic device of claim 9, wherein, if there is switching of an electrical connection path between the filter unit and the first microphone and the second microphone, the control unit is configured to:

concurrently operate the permanent operation adaptive filter and the periodic operation adaptive filter, and control the switch unit to delay the switching of the electrical connection path until an electrical signal passing the permanent operation adaptive filter and an electrical signal passing the periodic operation adaptive filter become similar equal to or more than a predetermined level.

15. A method for processing an audio signal, the method comprising:

receiving electrical signals from a plurality of microphones in an electronic device;

detecting acoustic characteristics of the received electrical signals;

comparing the acoustic characteristics and a reference acoustic characteristic suitable to a function of the electronic device;

selecting an electrical signal suitable to the reference acoustic characteristic among the received electrical signals based on a result of the comparison; and executing the function using a specific microphone corresponding to the selected electrical signal among the plurality of microphones.

16. The method of claim 15, wherein executing the function using the specific microphone corresponding to the selected electrical signal among the plurality of microphones comprises:

mixing the selected electrical signal and an electrical signal selected prior to the selected electrical signal;

during a predetermined time, executing the function using the mixed electrical signal; and after the predetermined time, executing the function using only the selected electrical signal.

17. The method of claim 15, wherein the acoustic characteristic is related to at least one of frequency, volume, echo, clipping, or saturation.

18. A method for processing an audio signal, the method comprising:

initiating a function;

receiving a first electrical signal from a first microphone designated to the function;

detecting an acoustic characteristic of the first electrical signal;

comparing the first acoustic characteristic and a reference acoustic characteristic suitable to the function;

if the first acoustic characteristic is suitable to the reference acoustic characteristic, executing the function using the first microphone corresponding to the first electrical signal;

if the first acoustic characteristic is unsuitable to the reference acoustic characteristic, receiving a second electrical signal from a second microphone;

detecting a second acoustic characteristic of the second electrical signal;

comparing the second acoustic characteristic and the reference acoustic characteristic;

if the second acoustic characteristic is suitable to the reference acoustic characteristic, executing the function using the second microphone corresponding to the second electrical signal; and if the second acoustic characteristic is unsuitable to the reference acoustic characteristic, executing the function using the first microphone corresponding to the first electrical signal.

* * * * *